United States Patent [19]

Cleary et al.

[11] 3,940,724

[45] Feb. 24, 1976

[54] RELAY CONTACT ADJUSTING ARRANGEMENT

[75] Inventors: Thomas C. Cleary, Northport; Joseph W. Schleisner, Valley Stream, both of N.Y.

[73] Assignee: Deutsch Relays, Inc., Long Island, N.Y.

[22] Filed: Apr. 4, 1974

[21] Appl. No.: 457,919

[52] U.S. Cl. ..... 335/197; 335/198; 200/249

[51] Int. Cl.[2] ..... H01H 1/48

[58] Field of Search ..... 335/197, 198, 200, 132; 200/249, 259

[56] References Cited

UNITED STATES PATENTS

| | | | |
|---|---|---|---|
| 2,611,050 | 9/1952 | Ponstingl | 335/197 X |
| 2,837,616 | 6/1958 | Jaidinger | 335/197 X |
| 3,452,428 | 7/1969 | Salomon | 335/197 X |
| 3,624,571 | 11/1971 | Magida | 335/197 |

*Primary Examiner*—G. Harris
*Attorney, Agent, or Firm*—Gausewitz, Carr & Rothenberg

[57] ABSTRACT

The relay contact adjusting arrangement of this invention involves the positioning of the header assembly and motor assembly of the relay in a fixed spaced relationship prior to final assembly, with the fixed and movable contacts in opposed pairs, and associated with an optical comparator so that enlarged images of the opposed contacts can be seen, after which adjusting tools are used to bend the supports of the fixed contacts for adjusting the spacing successively for each opposed pair of contacts to a spacing indicated on the screen of the comparator. The device includes a means for energizing the relay coil to hold the armature in a desired position while the adjustment takes place, and provides for the indexing of the assemblies through 180° to allow both the normally open and normally closed contacts to be viewed on the comparator screen.

38 Claims, 16 Drawing Figures

FIG. 9.
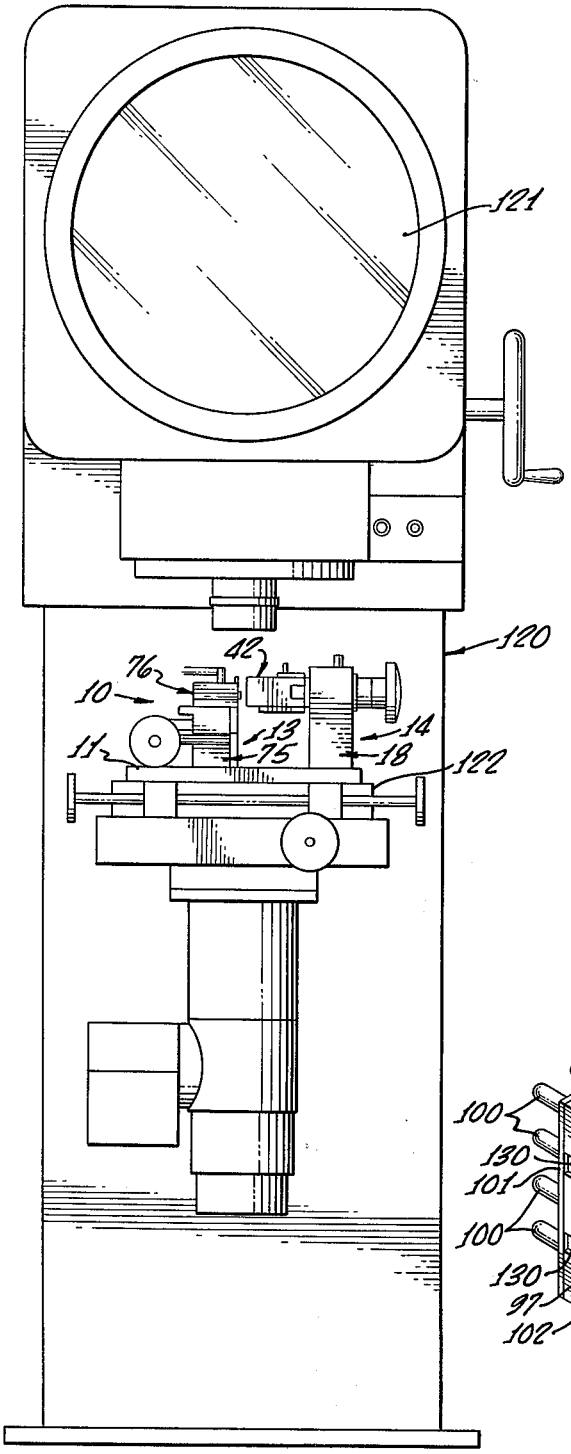
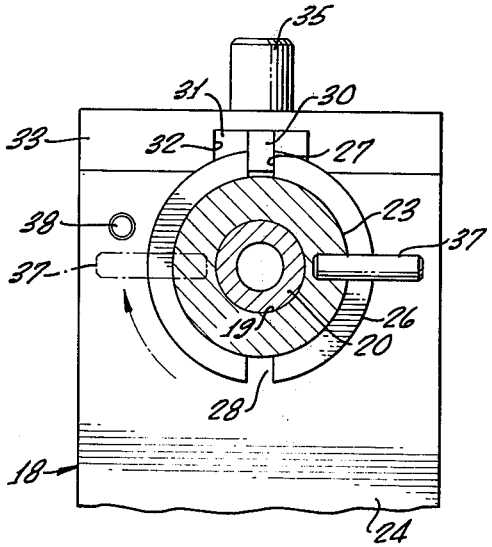
FIG. 3.
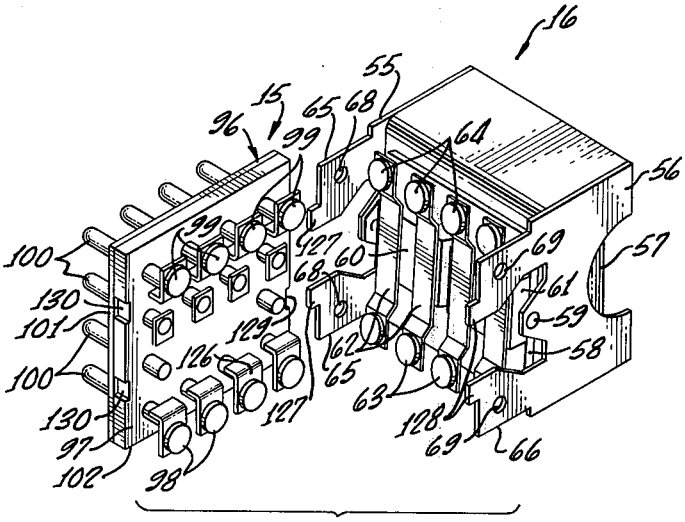
FIG. 6.

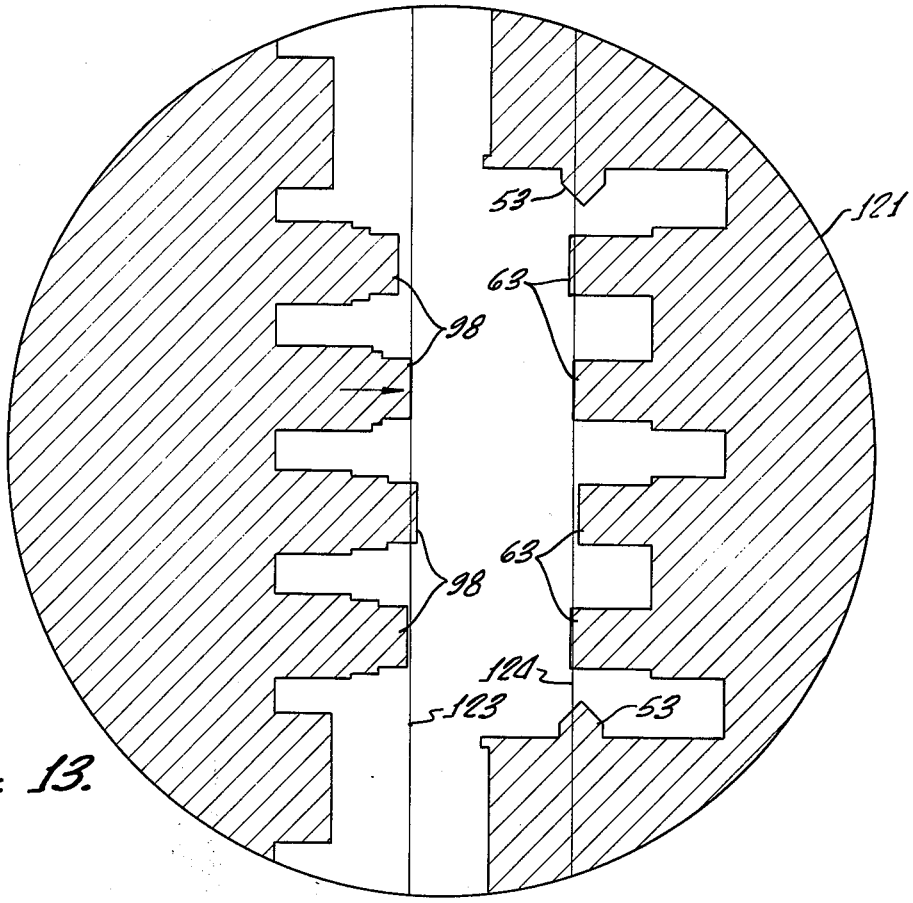
FIG. 13.
FIG. 8.
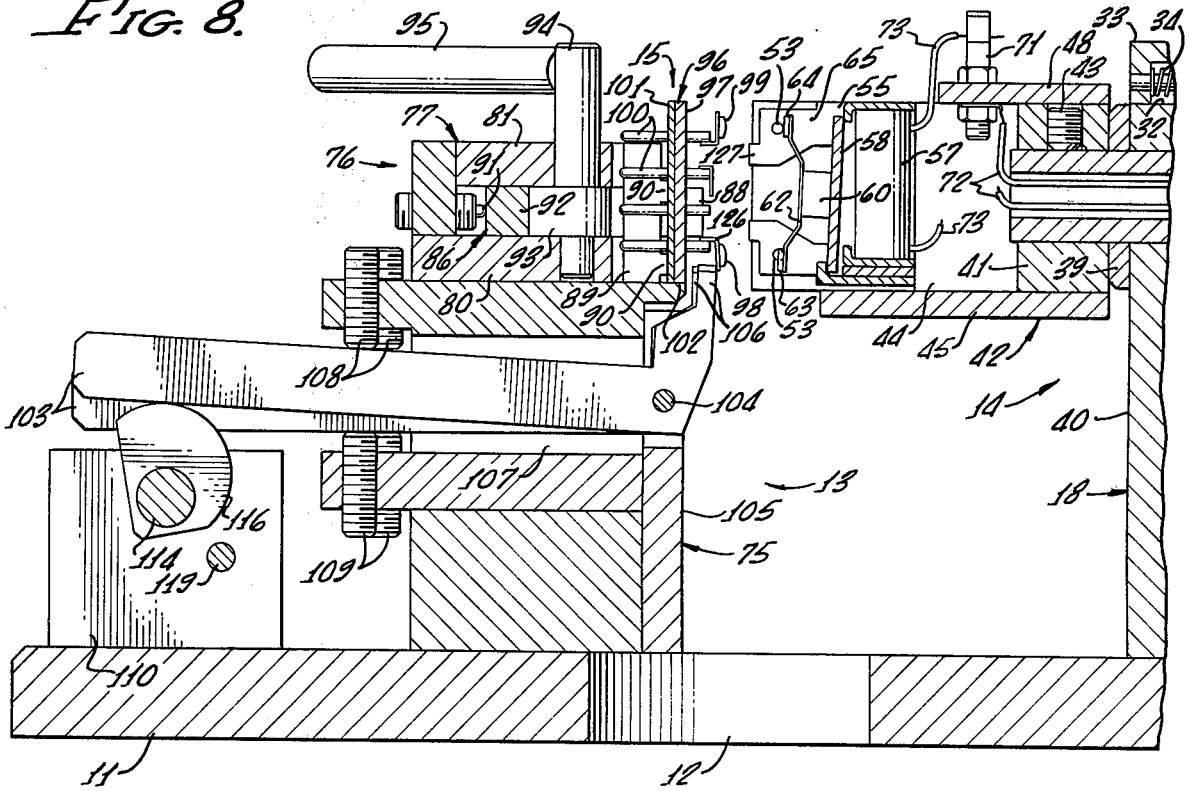

RELAY CONTACT ADJUSTING ARRANGEMENT

BACKGROUND OF THE INVENTION

1. Field of the Invention

This invention relates to the construction of electromagnetic relays.

2. Description of Prior Art

For relays which must meet exacting performance requirements, such as in the aerospace industry, it is necessary that the fixed and movable contacts of the relay have a predetermined spatial relationship. Otherwise the performance and reliability of the relay are impaired. The tolerances build up in manufacture and assembly of the relay to a degree such that adjustmens of the relative contact positions are necessary. In the past this has been accomplished by completing the assembly of the relay except for the housing, and then manually bending the supports for the fixed contacts to obtain a desired value of contact over-travel, contact pressure or a combination of both. This operation takes a highly skilled operator who has a basic knowledge of relay operation in order to understand what adjustments should be made to meet specifications. Considerable manual dexterity is required in bending the contact supports by means of pliers or other hand tools to effect an acceptable setting. Hence, contact adjustment has been a relatively slow and expensive operation. Moreover, the results have been inaccurate and inconsistent. Hand manipulation of tools and force gauges makes it quite difficult for even the most capable personnel to accomplish the accuracy of adjustment needed by such relays. Results vary from operator to operator and for any one person the adjustments may not be consistent between various times when the adjusting operations take place.

SUMMARY OF THE INVENTION

The present invention provides a vastly improved relay contact adjustment arrangement which eliminates all of the shortcomings noted above. Adjustment is made much more accurately and rapidly with minimal skill or understanding of relay operation and without the need for particular manual dexterity.

In accordance with the present invention, the contact adjustment takes place with the header assembly and motor assembly positioned in a fixed spaced relationship prior to their final assembly in the completed relay. The matched set of header assembly and motor assembly subsequently is connected together by utilizing the same positioning means as were employed during the adjustment, so that the contact adjustment is retained upon completion of the relay.

The header assembly and motor assembly both are placed upon a fixture which spaces them apart a predetermined distance with the fixed and movable contacts in opposed pairs. The motor assembly is positioned by pins on the fixture which engage four openings in the side plates of the motor assembly, which openings are subsequently used for positioning the motor assembly when it is to be welded to the header assembly. The fixture positions the header assembly by abutments engaging one side of the header plate, which is also the surface that is used in locating the header plate at the time the header is welded to the motor assembly. The mounting for the motor assembly includes electrical leads so that the coil of the motor may be energized to hold the armature in a selected position. Also, the motor assembly may be rotated through precisely 180° to position both the normally open and normally closed contacts in the location where the adjustment is to be made. The header assembly is held within a clamp which permits it to be removed and turned through 180° to accomplish the successive adjustments of its normally open and normally closed contacts. Adjacent to the fixed contacts are the ends of bell cranks which are selectively rotated by a movable cam to bend the contact supports, acting as the tools to achieve the adjustment. The bell cranks are springloaded providing them with a feel and sensitivity which enhances precise movement to effect exact contact positioning.

The adjustment is achieved through observing a magnified image of the opposed pairs of contacts on the screen of an optical comparator with which the fixture is associated. The screen includes parallel lines spaced a predetermined distance, which serves as the adjusting standard. First, the fixture is moved to put the movable contact of an opposed pair into adjacency with one of the lines on the screen. Then the support for the fixed contact is bent by its adjusting tool to cause that fixed contact to become tangent to the other line on the screen. The pairs of contacts are successively adjusted in this way so that each pair is given the proper spacing.

The fixture holds the header and motor assemblies apart a greater distance than they are in the completed relay so that there is a gap between the rows of opposed contacts. This is done so that the individual contacts can be viewed optically without engagement and resulting deflection of their supports. Also, it provides clearance for the adjusting tools. Further, the greater spacing allows adjustment of the fixed contacts without interference from the movable contacts, and permits the motor assembly to be rotated to index it 180° without interference from the header assembly.

BRIEF DESCRIPTION OF THE DRAWINGS

FIG. 3 is a fragmentary transverse sectional view taken along line 3—3 of FIG. 2;

FIG. 6 is a perspective view showing a header assembly and motor assembly of a relay prior to association with the fixture for adjustment of the contact positions;

FIG. 8 is a fragmentary longitudinal sectional view of a portion of the fixture during adjustment of the position of a contact;

FIG. 9 is an elevational view of the fixture associated with an optical comparator for adjustment of the contacts;

FIG. 13 is an enlarged elevational view of the screen of the comparator during contact adjustment;

DESCRIPTION OF THE PREFERRED EMBODIMENT

Figure 1A:
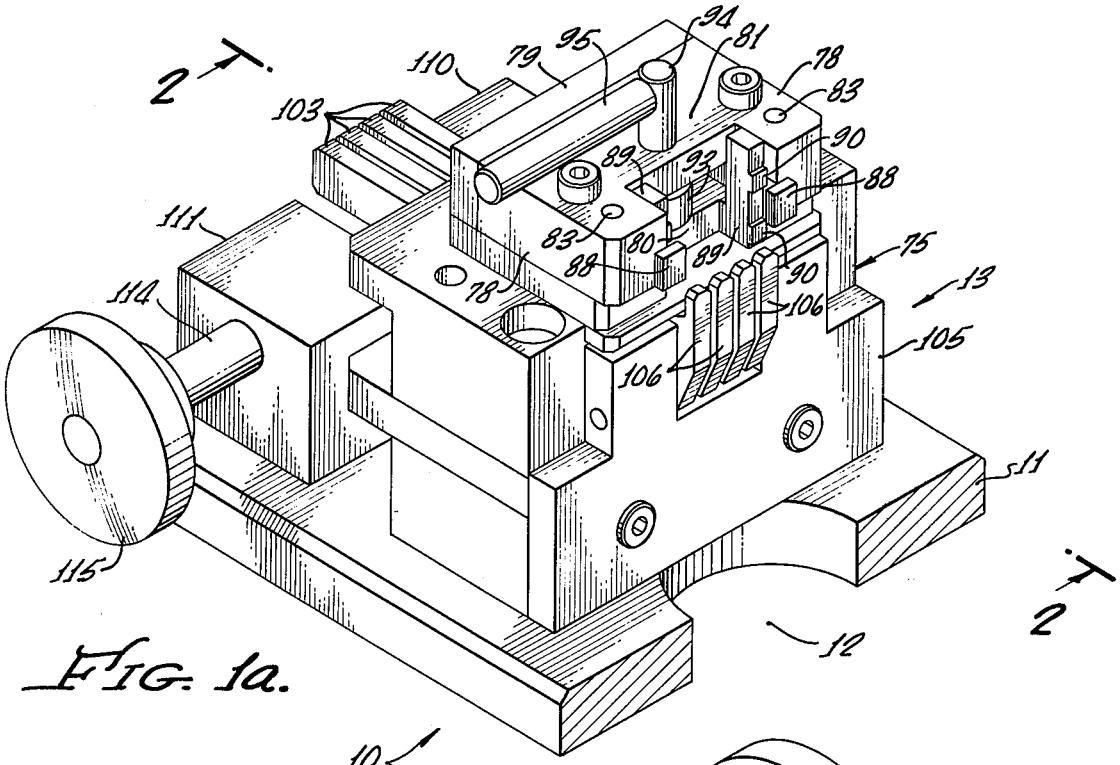
FIGS. 1*a* and 1*b* are perspective view of the fixture of this invention, FIG. 1*a* being a view of the section of the fixture which supports the header assembly and FIG. 1*b* being a view of the portion of the fixture that supports the motor assembly.
Figure 1B:
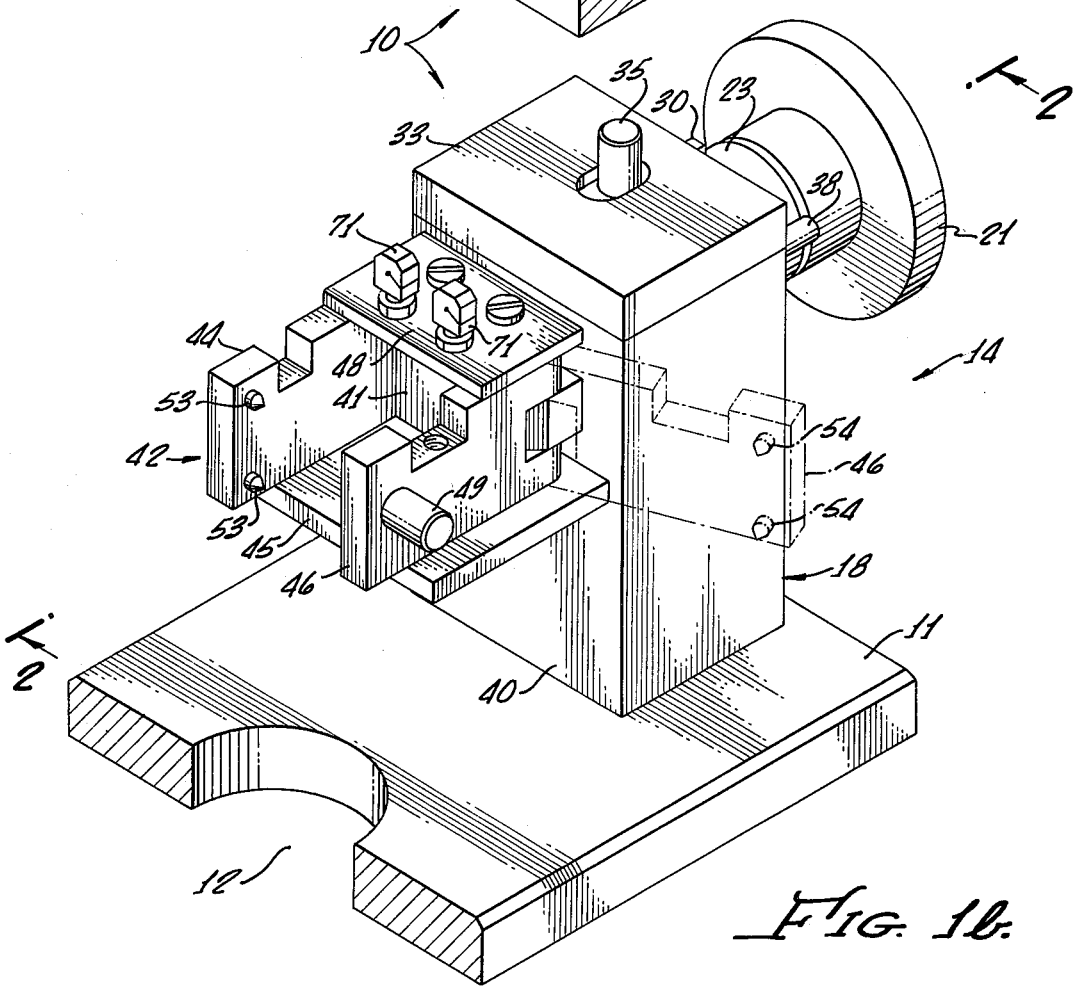

The fixture 10 of this invention, as seen in FIG. 1, includes a flat base plate 11 which has a generally central opening 12 through it and carries relay component support units 13 and 14. The support unit 13 of the fixture holds the header assembly 15 of the relay when the fixture is in use, with the motor assembly 16 being retained by the support unit 14.

The support unit 14 includes a rectangular vertical post 18 provided with a circular horizontal opening 19 within which is a hollow shaft 20. On the outer end of the shaft 20 is a knob 21 held to the shaft by a set screw 22. A stop assembly inwardly of the knob 21 includes a collar 23 adjacent the outer surface 24 of the post 18, coupled to the shaft 20 by a set screw 25. A split ring 26, having diametrically opposed slots 27 and 28, circumscribes the collar 23 adjacent the post 18. These slots are adapted to receive a pawl 30 projecting from the end of a plunger 31 which rests upon the top of the post 18 and is slidable horizontally in a guide opening 32 in plate 33 fastened to the top of the post. A compression spring 34 in the opening 32 engages the inner end of the plunger 31, biasing it outwardly to the position where its pawl can enter one of the slots 27 and 28. Accordingly, the shaft 20 has two rotational positions 180° apart. In the position shown in the drawing (e.g., FIG. 3), the pawl 30 is in the slot 27 holding the shaft 20 against rotation. The plunger 31 may be retracted by means of the knob 35 attached to it, withdrawing the pawl 30 from the slot 27 and allowing the rotation of shaft 20 by the knob 21. When the plunger 31 is released after 180° rotation of the shaft 20, the pawl 30 will enter the slot 28 in the split ring 26, thereby holding the shaft in its second position which is 180° displaced from the first. An overtravel stop is provided by a pin 37 projecting radially outwardly from the collar 23 and a horizontal pin 38 that extends from the rearward side 24 of the post 18.

A washer 39 on the shaft 20 is positioned adjacent the inside surface 40 of the post 18.

Figures 4, 5:
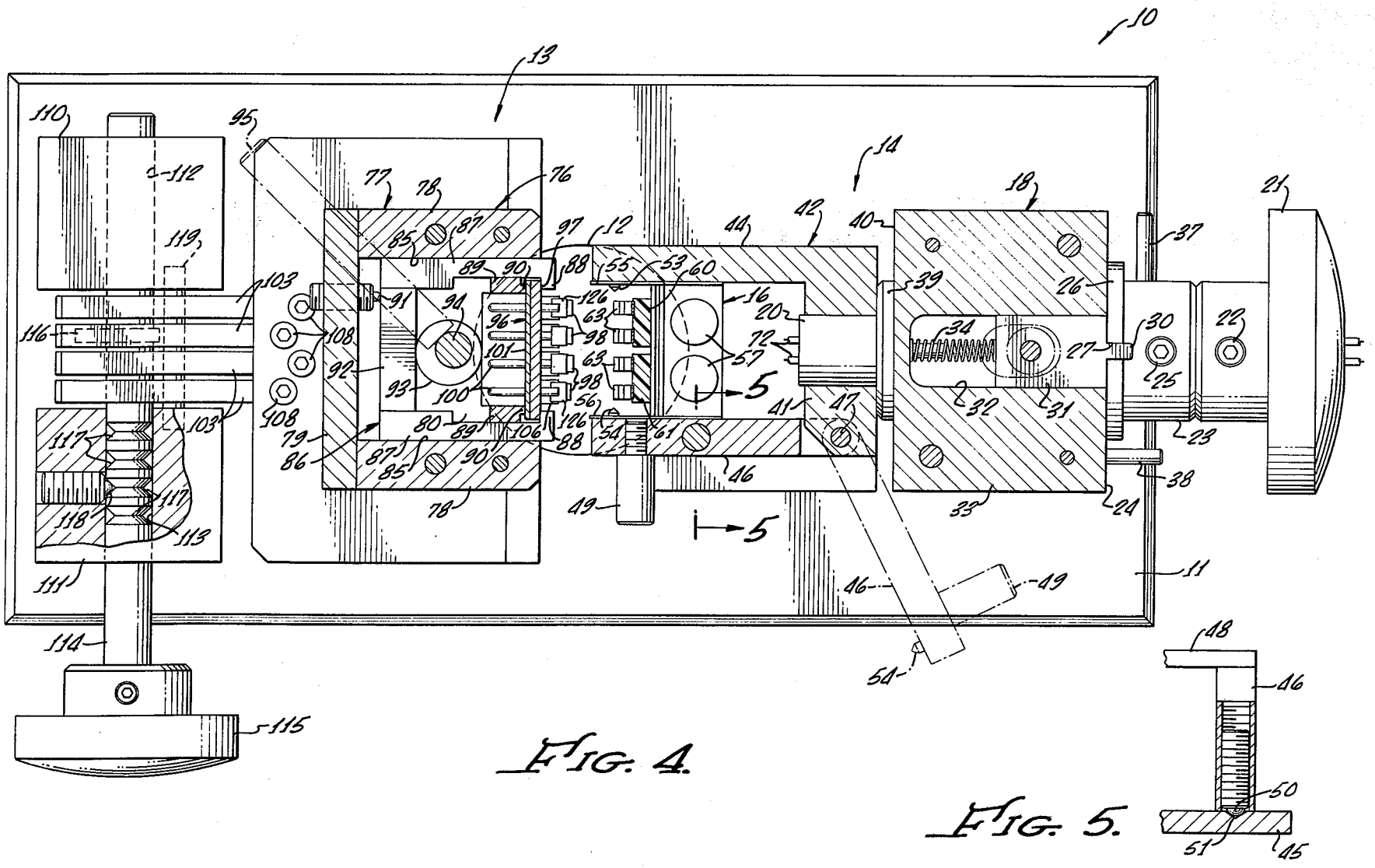
FIG. 4 is a longitudinal sectional view taken along line 4—4 of FIG. 2.
FIG. 5 is a fragmentary sectional view taken along line 5—5 of FIG. 4.

Beyond the washer 39 is the rearward wall 41 of a housing 42, held to the shaft 20 in engagement with the washer 39 by a set screw 43. Accordingly, the collar 23 and housing 42 cooperate to prevent axial travel of the shaft 20 relative to the post 18. A sidewall 44 extends forwardly from the rearward wall 41 of the housing 42, and a bottom wall 45 is located at the lower edges of the walls 41 and 44. Opposite from the wall 44 is a door 46 which can rotate about a vertical hinge pin 47 that extends between the lower wall 45 and a partial upper wall 48. A knob 49 on the door 46 is for use in rotating it. A springloaded plunger 50 is carried by the door 46 at its lower edge, having an end which can enter a recess 51 in the bottom wall 45 to position door 46 parallel to the sidewall 44 when closed (see FIG. 5). In this position a pair of vertically aligned spaced pins 53 that extend inwardly a short distance from sidewall 44 are directly opposite from similar pins 54 on the door 46.

The relay motor assembly 16, which is conventional, includes a pair of side plates 55 and 56 between which are the coils 57 of the relay (see FIG. 6). The armature 58 of the relay motor is pivotal about a journal 59 at the side plate 56 and a similar journal at the side plate 55. Contact carriers 60 and 61 of dielectric material are secured to the armature 58 and carry reeds 62 at the outer ends of which are normally open contacts 63 and normally closed contacts 64. In the embodiment shown, there are four normally open contacts 63 and a similar number of the normally closed contacts 64, each groups of contacts being positioned in a row perpendicular to the side plates 55 and 56. When the relay is in one position, the normally closed contacts 64 are pivoted outwardly by the armature 58 and in the other position the normally open contacts 63 are rotated to an outer position by the armature.

The side plates 55 and 56 of the motor assembly 16 have bifurcated end portions 65 and 66, respectively, which extend outwardly beyond the contacts 63 and 64. Within these end portions of the plates 55 and 56 are pairs of openings 68 and 69. These openings are closely held dimensionally both as to their size and location, and are used at various times during the assembly of the relay motor as a means to position the components. In the final assembly of the relay, the openings 68 and 69 also are used for accurately locating the motor assembly with respect to the header assembly as these two components are welded together, as will be explained below.

The motor assembly 16 is associated with its support unit 14 by first opening the door 46 and positioning the motor assembly such that the row of normally open contacts 63 is adjacent the bottom wall 45 and the openings 68 of the side plate 55 complementarily receive the pins 53 of sidewall 44. The door 46 is then closed so that its pins 54 enter the openings 69 of the plate 56 of the motor assembly. This accurately positions the motor assembly with respect to its support unit 14 by using the reference openings 68 and 69 of the motor assembly as the positioning means. With the door 46 closed, the space between the door and the sidewall 44 is substantially the same as the width of the motor assembly between the plates 55 and 56 so that motor assembly is retained firmly. The bottom wall 45 provides a convenient means for facilitating the association of the relay motor assembly with the fixture by supporting the motor assembly in the position where it will accept the pins 53 and 54 as the attachment is made.

The top wall 48 of the housing 42 is of dielectric material and includes a pair of quick-connect wire terminals 71 projecting from its upper surface. Lead wires 72 are permanently connected to the bottom ends of the terminals 71 and extend out of the fixture through the hollow shaft 20. Accordingly, the leads 72 of the relay motor assembly 16 may be connected to the terminals 71, which allows the relay coils to be energized by connecting the lead wire 72 to an appropriate source of voltage.

Figure 7:
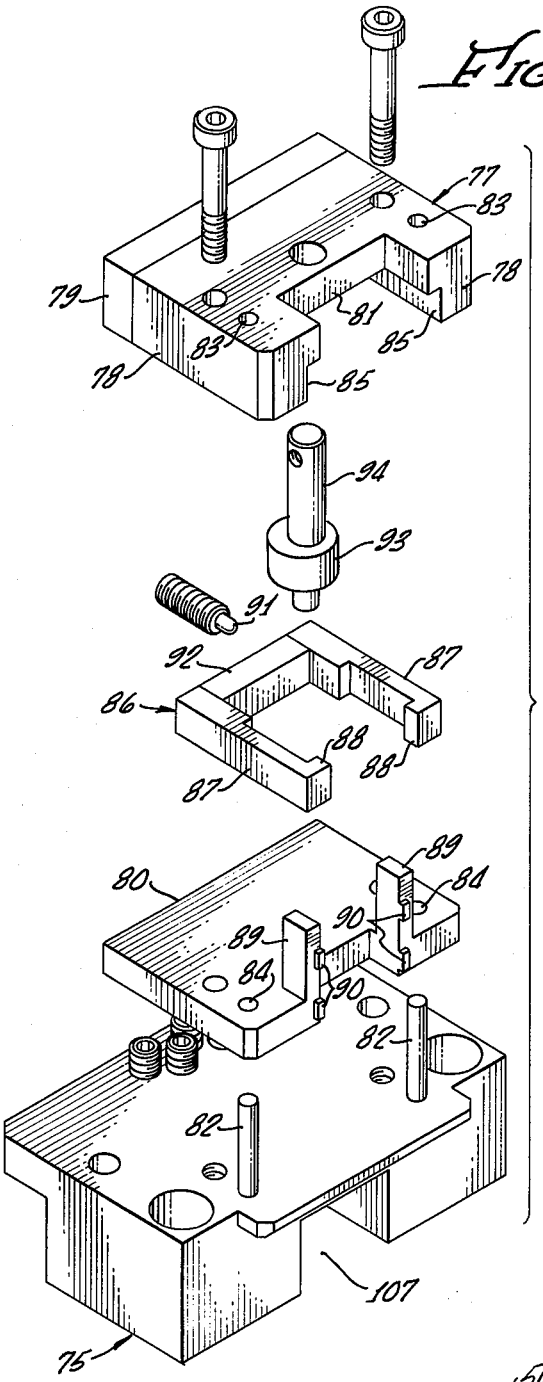
FIG. 7 is an exploded perspective view of the portion of the fixture which retains the header assembly.

The header support 13 includes a base unit 75 which at its upper end carries a clamp assembly 76 for holding and positioning the header assembly 15. The clamp assembly 76 includes a fixed unit 77 having parallel spaced sidewalls 78 and a rearward wall 79. These walls rest on a bottom wall 80 which is secured to the upper end of the base 75. Vertical pins 82 project from the forward portion of the base 75 and fit in openings 83 and 84 in the fixed clamp elements 77 and 80, aligning the clamp with the base (see FIG. 7). A top wall 81 extends over the rearward portion of the fixed unit 77.

The inner lower edges of the sidewalls 78 are provided with longitudinally extending notches 85. The clamp 76 includes a movable member 86 that is generally U-shaped, having side portions 87 that fit within the notches 85 in the sidewalls 78. Inwardly directed short flanges 88 are at the outer ends of the side portions 87 of the movable clamp member 86 and perpendicular to the sides. Vertical fixed stop members 89, each of which has a pair of vertically spaced forwardly projecting lugs 90, are connected to the forward edge of the bottom wall 80 of the fixed portion of the clamp. This positions the stop members 89 such that their lugs 90 are spaced inwardly from the flanges 88 of the movable clamp member 86. A spring biased plunger 91 on the rearward wall 79 of the fixed portion of the clamp engages the rearward portion 92 of the movable clamp element 86, biasing this member inwardly so as to move the flanges 88 away from the lugs 90 of the fixed vertical stop members 89. The movable clamp member 86 can be shifted in the opposite direction against the force of the plunger 91 by means of a cam 93 rotatable by a vertical pin 94 actuated by an external handle 95.

The header assembly 15 includes a flat header plate 96 on one side 97 of which is a row of normally open contacts 98 parallel to a second row of normally closed contacts 99. The contacts 98 and 99 make electrical connections to pins 100 projecting from the opposite side 101 of the header plate 96.

In securing the header assembly 15 in the clamp 76, the cam 93 is released, allowing the plunger 91 to move the flanges 88 away from the lugs 90. The header then is positioned in the clamp 76 with the edges of the header plate 96 between the flanges 88 and the fixed lugs 90. It is located initially with the longitudinal edge 102 of the header plate 96 resting on the bottom wall 80 of the clamp, so that the normally open contacts 98 are at the lower edge of the clamp and opposite from the normally open contacts 63 of the motor assembly 16. Thus, the contacts are positioned in the same relationship as in a completed relay, but are spaced farther apart. The handle 95 then is rotated to cause the lobe of the cam 93 to push rearwardly on the inner member 92 of the movable portion 86 of the clamp 76, thereby causing the flanges 88 to bear against the surface 97 of the header plate 96 adjacent the contacts 98 and 99. The opposite surface 101 of the header plate 96 thereby is forced against the fixed lugs 90, which act as abutments that position the header assembly. This provides a known location for the header assembly 15 because the surface 101 of the header plate 96 later is used as the locating surface for the header assembly when it is connected to the motor assembly 16, as explained below.

Beneath the clamp assembly 76 are four bell cranks 103 which are pivotal about a horizontal shaft 104 carried by the bifurcated forward vertical wall 105 of the base 75. The bell cranks 103 are spaced apart a distance such that when a header assembly is in the fixture, each bell crank is aligned with one of the fixed contacts. The upper ends 106 of the bell cranks then are positioned adjacent and immediately inwardly of the fixed contacts 98.

Figure 2:
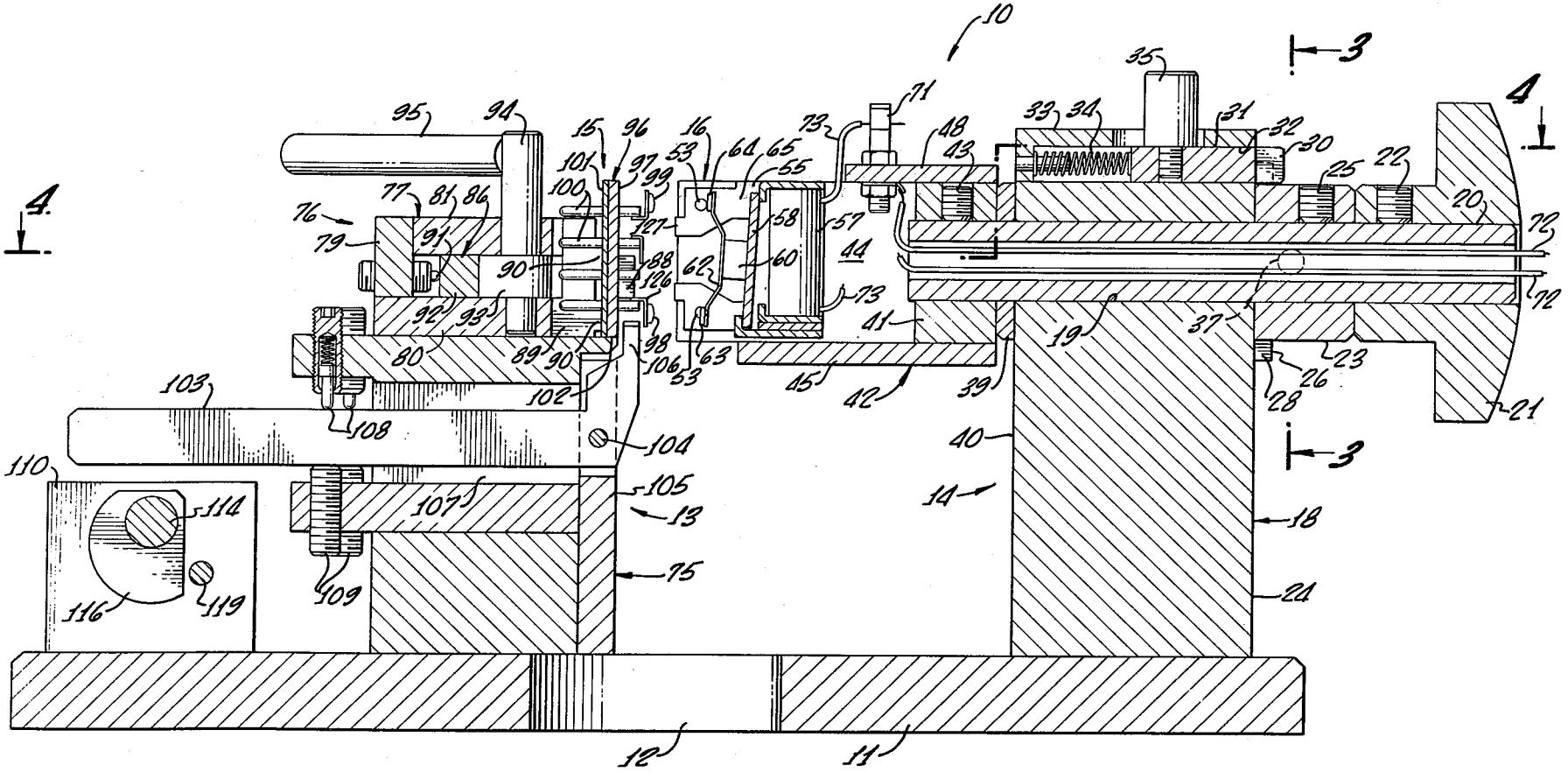
FIG. 2 is a longitudinal sectional view of the fixture taken along lines 2—2 of FIGS. 1*a* and 1*b*, but with a header assembly and motor assembly positioned in the fixture.

From the mounting shaft 104, the bell cranks 103 have elongated end portions which fit through an opening 107 in the base 75, extending beyond the base where their upper ends are engaged by spring biased plungers 108, which are similar to the plunger 91 that biases the clamp 76 to its open position. This urges the bell cranks 103 in a counter clockwise direction, as illustrated in FIG. 2, so that their lower surfaces engage adjustable screw stops 109.

Outwardly of the base 75 are two bearing blocks 110 and 111 mounted on the plate 11 in a spaced relationship and provided with horizontal openings 112 and 113. A shaft 114 extends through the opening 112 and 113 and is rotatable by a knob 115. A cam 116 is carried by and rotatable with the shaft 114 between the bearing blocks 110 and 111. The shaft 114 is axially movable so that the cam 116 may be positioned beneath the outer end of any of the bell cranks 103. The shaft 114 includes four V-shaped grooves 117, spaced apart the same distance as the bell cranks 103 and engageable by a springloaded plunger 118. This provides a means for indexing the cam 116 beneath a selected one of the bell cranks 103. Consequently, clockwise rotation of the cam 116 will cause it to bear against a selected bell crank 103, rotating the bell crank also in the clockwise direction, as the device is shown in FIG. 2. The spring pressed plunger 108 provides resistance to the movement of the bell crank, which aids in imparting precise increments of movement to it as the cam is turned. The plungers 108 also provide automatic return of the bell cranks to their engagement with the stops 109. The cam 116 is prevented from overtravel in the reverse direction by means of a stop pin 119 that extends between the blocks 110 and 111 adjacent the shaft 114.

In use of a device 10 of this invention, as indicated in FIG. 9, it is associated with an optical comparator 120 which is of conventional construction except for special markings placed upon its screen 121, as explained below. The support plate 11 of the device 10 is positioned on the stage 122 of the optical comparator 120, while the central opening 12 in the support plate 11 allows for passage of light and focusing on the bottom rows of contacts of the header assembly 15 and motor assembly 16. As a result, an enlarged image of the contacts appears on the screen 121 of the comparator 120, as indicated in FIG. 13. On this screen are provided two parallel lines, 123 and 124. These represent the proper spacing for the contacts of the header assembly 15 and motor assembly 16, with compensation for the fact that the contacts, as mounted in the fixture, are spaced apart a greater distance than they will be in the assembled relay. Compensation is also made for the fact that the comparator optics focuses on the outer periphery of the movable contacts, but the actual electrical contact point is hidden due to the angular configuration of the contact arm.

With the header assembly 15 and motor assembly 16 mounted as described above, that is, with the normally open contacts along the lower edge, the operator manually biases the armature 58 to the normally open, or energized, position, and then applies voltage to the coil through the leads 72 to secure the armature in this position. The operator then adjusts the opposed pairs of fixed and movable contacts successively. In doing this, the stage 122 of the comparator is adjusted so that the image of the selected movable contact 63 is exactly tangent to the righthand line 124 on the screen 121.

The image of the opposite fixed contact 98 then will be outside of the parallel line 123, which indicates that the contact spacing is too great. The operator moves the shaft 114 to position the cam 116 beneath the end of the bell crank 103 which is opposite the fixed contact 98 which is to be adjusted. Then the shaft 114 is rotated so that the cam 116 causes clockwise rotation of the appropriate bell crank 103. The upper end of 106 of this bell crank is brought into engagement with the undersurface of the support 126 for the contact 98 and with continued rotation bends this support outwardly, as indicated in FIG. 8. This brings the selected fixed contact 98, carried by the support 126, closer to the opposite contact 63 of the motor assembly, the movement being stopped by the operator when the contact 98 is exactly tangent to the line 123 to the screen 121. This completes the adjustment of the set of fixed and movable contacts.

Then the shaft 114 is moved until the cam 116 is adjacent the end of the next bell crank 103. The operation is repeated as the first movable contact 63 is positioned in tangency with the line 124 on the screen 121. Then the second bell crank is rotated to bend the support 126 for the second fixed contact 98 to bring the image of that contact to a position of tangency with the line 123.

The same operation is carried out for the other pairs of contacts, thereby properly matching the normally open contacts of the relay.

Figure 10:
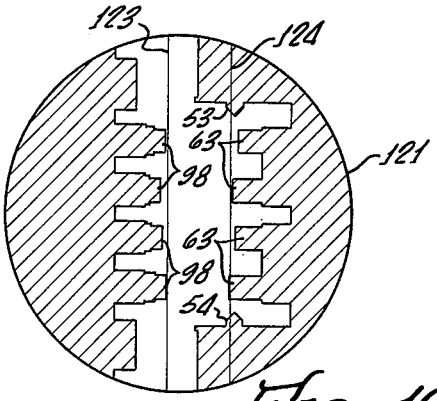
FIGS. 10, 11 and 12 are elevational views of the screen of the comparator, illustrating successive steps in contact adjustment.
Figure 11:
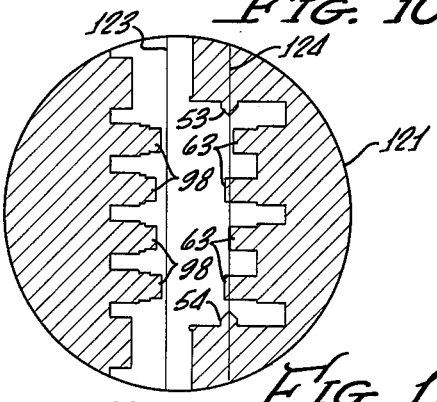
Figure 12:
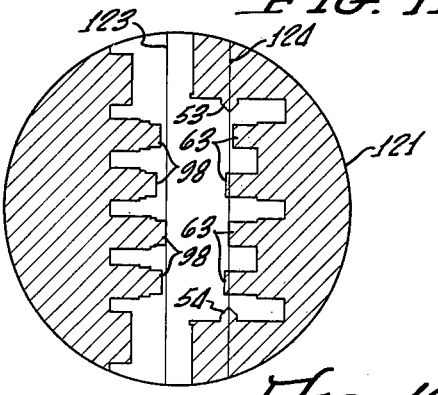

FIGS. 10, 11 and 12 illustrate the sequence of operations in adjusting the second pair of contacts from the bottom as they appear on the screen 121. As seen in FIG. 10, the two contacts 63 and 98 of the second pair are too far apart, being outside of the lines 123 and 124. (The bottom pair of opposed contacts 63 and 98 has just been adjusted so that each of those contacts is tangent to a line on the screen.) The stage 122 of the comparator is moved to the position of FIG. 11 where the selected movable contact 63 is tangent to the line 124. Then, as indicated in FIG. 12, the contact 98 is set to a position of tangency with the line 123, completing the adjustment of the pair of contacts.

In FIGS. 8 and 13 the adjustment of the next pair of opposed contacts is shown.

In making these adjustments, the gap between the opposite pairs of contact is closely controlled, but the rows of fixed and movable contacts do not end up straight. This is because there is inherently a small variation in the relative positioning of the various movable contacts which serve as the point from which the adjustment is made. The fact that the rows are not straight is of no consequence because the critical factor is the spacing between the contacts of each pair of opposed contacts and not the precise relationship of one pair to the other. The adjustment alway decreases the spacing between the opposed contacts so that if the spacing initially is too small the contact support 126 is bent to provide an enlarged spacing before the adjustment operation is commenced.

After the normally open contacts have been adjusted, as described above, the motor assembly 16 is rotated 180° to bring the normally closed contacts 64 to the bottom edge. This is, of course, accomplished by pulling back on the plunger 31 to remove the pawl 30 from the notch 27, then rotating the shaft 20 180° and releasing the plunger 31 to cause the pawl to enter the slot 28. The header assembly 15 also is rotated 180° by removing it from the clamp 76, turning it over and then putting it back into the clamp. This locates the normally closed contacts 99 along the lower edge opposite from the movable normally closed contacts 64. With the coil de-energized, the armature 58 of the motor assembly 16 is manually moved to the normally closed position. The coil is then re-energized so as to be secured in this position. The normally closed contacts 64 and 99 then are adjusted by the appropriate rotation of the bell cranks in the same way as described above for the normally open contacts.

After both sets of contacts have been adjusted, the header assembly 15 and motor assembly 16 are removed from the fixture 10 and kept as a matched pair for final assembly in the relay. When the relay is completed, the adjustment is retained because the indexing surfaces used when the header and motor are attached together are the same ones that are employed in positioning the header and motor in the fixture.

Figure 14:
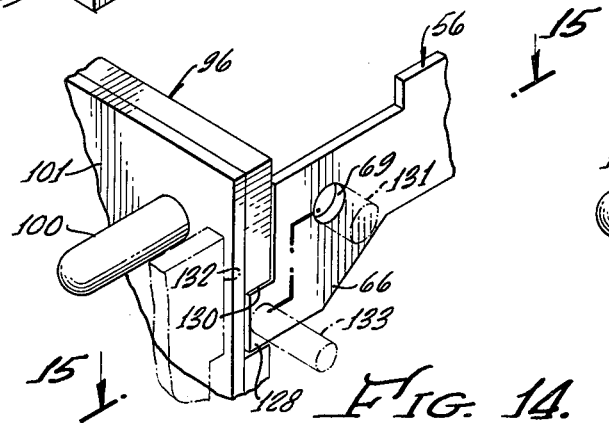
FIG. 14 is a fragmentary perspective view illustrating the attachment of the header assembly to the motor assembly following contact adjustment.
Figure 15:
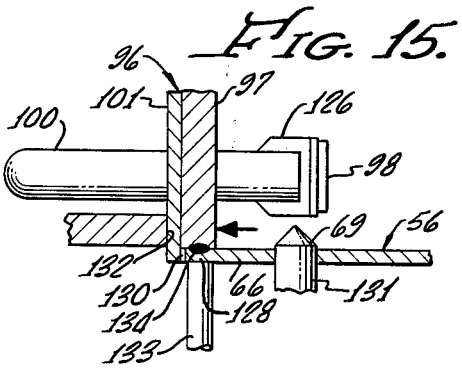
FIG. 15 is a sectional view taken along line 15—15 of FIG. 14, but with the locating elements and welding electrode in position as used in joining the header and motor assemblies.

When the motor assembly and header assembly are connected, the tabs 127 and 128 of the bifurcated projecting portions 65 and 66 of the side plates 55 and 56, respectively, fit within notches 129 and 130 in the opposite side edges of the header plate 96. The tabs are welded to the header plate at the notches to accomplish the attachment of the header assembly to the motor assembly (see FIGS. 14 and 15). At the time the welds are made, the motor assembly is positioned by means of the openings 68 and 69 in the side plates 55 and 56, respectively, and the header assembly is positioned by the surface 101 of the header plate 96. Pins 131 complementarily enter the openings 68 and 69, while the surface 101 of the header plate 96 is forced against a locating surface 132. The welding electrode 133 then produces a spot weld 134. With the same locating surfaces being used both in the final assembly and in the contact adjustment, the contact setting is permanent and retained as the relay is completed.

In the event that it is not practical for a particular relay to use the same types of openings and surfaces as described above for the positioning means, the fixture may be modified to operate on such different locating surfaces as the relay may have. In any event, the locating surfaces for the assembly of the relay are the same locating surfaces that are used in positioning the relay components in the contact adjusting fixture 10.

The foregoing detailed description is to be clearly understood as given by way of illustration and example only, the spirit and scope of this invention being limited solely by the appended claims.

We claim:

1. In combination with a relay having a movable means having movable contact means and fixed means having fixed contact means, a device for adjusting the spacing of the contacts of said relay comprising:

means for positioning said movable means in a first predetermined location, means for positioning said fixed means in a second predetermined location such that said movable contact means is opposite said fixed contact means and spaced therefrom a distance greater than the spacing thereof in a completed relay, and means for moving one of said contact means relative to the other of said contact means while said movable means is in said first predetermined location and said fixed means is in said second predetermined location for varying said spacing between said movable and said fixed contact means to a predetermined value.

2. A device for adjusting the spacing of contacts of a relay having a movable means having movable contact means and fixed means having fixed contact means comprising:

means for positioning such a movable means in a first predetermined location, means for positioning such a fixed means in a second predetermined location such that said movable contact means is opposite said fixed contact means and spaced therefrom, means for moving one of said contact means relative to the other of said contact means while said movable means is in a said first predetermined location and said fixed means is in said second predetermined location for varying said spacing between said movable and said fixed contact means, and means for reproducing an enlarged image of said movable and fixed contact means when said movable means is in said first predetermined location and said fixed contact means is in said second predetermined location for facilitating said varying of said spacing between said movable and fixed contact means for setting said spacing to a predetermined value.

3. A device as recited in claim 2 including indicia for said means for reproducing an enlarged image of said fixed and movable contact means for providing a visible indication of said spacing between said movable and fixed contact means.

4. In combination with a relay motor assembly having a coil, an armature and a group of movable contacts carried by said armature, and a relay header assembly having a group of fixed contacts, which assemblies are connected together in a predetermined relationship in a completed relay, a device for adjusting said contacts comprising:

means for positioning said relay motor assembly in a first predetermined location, means for positioning said relay header assembly in a second predetermined location correlated to said predetermined relationship such that said group of movable contacts of said motor assembly and said group of fixed contacts of said header assembly provide opposed pairs of contacts spaced apart a greater distance than the spacing thereof in an assembled relay, and means for moving said contacts of one of said groups relative to said contacts of the other of said groups for setting the spacing of said opposed pairs of contacts of said groups to predetermined values.

5. A device as recited in claim 4 in which each of said motor assembly and said header assembly includes index surface means for relative positioning of the same at the time of connection of said motor assembly to said header assembly in said predetermined relationship, in which said means for positioning said motor assembly and said header assembly includes means for engaging said index surface means.

6. A device as recited in claim 5 in which said motor assembly includes opposed side plates defining openings in predetermined locations for providing said index surface means, and said positioning means for said motor assembly includes pins in predetermined positions substantially complementarily received in said openings.

7. A device as recited in claim 6 in which said positioning means for said motor assembly includes at least one fixed pin, and at least one movable pin movable between said predetermined position thereof and a position remote therefrom.

8. A device as recited in claim 7 in which said positioning means for said motor assembly includes:

a fixed wall, at least one pin carried by said fixed wall, a pivotal door, at least one pin carried by said door, said door being pivotal between a first location in which said pin carried thereby is in said predetermined position thereof and a second location remote therefrom, said door when in said first location being substantially parallel to said wall and spaced therefrom a distance adapted to substantially complementarily receive said side plates therebetween, and releasable means for holding said door in said first location.

9. A device as recited in claim 5 in which said means for positioning said motor assembly includes means for energizing said coil thereof for thereby positioning said armature and said movable contacts in predetermined positions relative to said motor assembly.

10. A device as recited in claim 9 in which said motor assembly and said header assembly each includes a group of normally open contacts on one side thereof and a group of normally closed contacts on the opposite side thereof, and in which said means for positioning said motor assembly and said header assembly includes means for selectively positioning said groups of normally open contacts in a predetermined location and said normally closed contacts in said predetermined location.

11. A device as recited in claim 10 in which said means for positioning said normally open and said normally closed contacts of said motor assembly in said predetermined location includes a rotatable member for holding said motor assembly, and means for indexing said rotatable member for rotation between two positions 180° apart.

12. A device as recited in claim 5 in which header assembly includes a substantially flat plate, said index surface means of said header assembly is one of the principal surfaces of said plate, and in which said means for positioning said header assembly includes abutment surface means for engaging said one principal surface of said plate.

13. A device as recited in claim 12 including a clamp means for engaging the opposite principal surface of said plate for urging said one principal surface against said abutment surface means.

14. A device as recited in claim 13 including a cam means for actuating said clamp.

15. A device as recited in claim 4 in which said header assembly includes a bendable support for each of said contacts of said header assembly, and in which said means for moving the contacts of one of said groups includes means for bending said supports of said contacts of said header assembly.

16. A device as recited in claim 15 in which said means for bending said supports includes means for bending said supports in a direction such as to move said fixed contacts toward said movable contacts.

17. A device as recited in claim 16 in which said means for bending said supports of said contacts of said header assembly includes means for bending said supports selectively and individually.

18. A device as recited in claim 17 in which said means for bending said supports includes a bell crank for each of said supports, each of said bell cranks having an end portion adjacent one of said supports for bending the same upon rotation of said bell crank.

19. A device as recited in claim 18 including a cam positionable adjacent each of said bell cranks for effecting rotation thereof for causing each of said bell cranks selectively to engage one of said supports for bending the same.

20. A device as recited in claim 4 including in addition a magnifying viewing means for viewing the spacing between said groups of contacts of said motor assembly and said header assembly.

21. A device as recited in claim 20 in which said viewing means includes an optical comparator.

22. A device as recited in claim 21 in which said optical comparator includes a screen for viewing enlarged representations of said groups of contacts, said screen having indicia thereon for providing a visual means for said adjusting of said spacing between said opposed pairs of contacts.

23. A device as recited in claim 21 in which said optical comparator includes a screen for viewing enlarged representations of said groups of contacts, said screen having a duality of substantially parallel lines thereon in a predetermined spaced relationship for permitting one contact of each of said opposing pairs of contacts to be positioned in tangency with one of said lines, and the other contact of said pair to be moved into tangency with the other of said lines upon said adjustment of said spacing of said contacts.

24. The method of adjusting the contacts of a relay having a motor assembly having at least one movable contact and a header assembly connected to said motor assembly in a predetermined relationship therewith, said header assembly having at least one fixed contact for engagement with said movable contact, comprising the steps of:

prior to connection of said header assembly to said motor assembly, positioning said header assembly and motor assembly in predetermined positions correlated to said predetermined relationship such that said contacts thereof are opposed and spaced apart a distance greater than the distance between said contacts following connection of said header assembly to said motor assembly, and moving one of said opposed contacts to adjust said spacing between said contacts to a predetermined value.

25. The method as recited in claim 24 in which said fixed contact is moved in said moving of one of said opposed contacts.

26. The method as recited in claim 25 in which said fixed contact is moved toward said movable contact.

27. The method as recited in claim 24 in which said motor assembly can be energized for displacing said movable contact relatively toward said fixed contact, and including the step of so energizing said motor assembly prior to said moving of said fixed contact.

28. The method as recited in claim 24 in which said motor assembly and said header assembly have reference surfaces used in the final positioning of said motor assembly and header assembly at the time the same are connected together, and in which said reference surfaces are engaged in said positioning of said motor assembly and said header assembly for correlating said predetermined positions of said motor assembly and header assembly to said predetermined relationship thereof when connected.

29. The method as recited in claim 28 in which said motor assembly includes portions having therethrough for providing said reference surface of said motor assembly, and in which pins are inserted in said openings for said positioning of said motor assembly.

30. The method as recited in claim 28 in which said header assembly has a plate having a principal surface on the side thereof remote from said fixed contacts, said principal surface being said reference surface of said header assembly, and in which said principal surface is engaged by spaced abutments in said positioning of said header assembly.

31. The method as recited in claim 24 including the step of providing an enlarged image of said fixed and movable contacts when said motor assembly and header assembly are in said predetermined positions thereof, and in which said adjustment of said spacing between said fixed and movable contacts is accomplished by observing said image during said movement of one of said contacts.

32. The method as recited in claim 31 including the step of providing fixed indicia associated with said image for providing a reference for said adjustment of said spacing.

33. The method as recited in claim 24 including the steps of providing an enlarged image of said contacts on a screen when said motor assembly and header assembly are in said predetermined position thereof, and providing parallel lines on said screen spaced apart a predetermined distance for use in said adjustment of said spacing of said contacts.

34. The method as recited in claim 33 in which for said adjustment of said spacing of said contacts said motor assembly and said header assembly are moved as a unit to a position where said movable contact is tangent to one of said parallel lines, and said fixed contact is then moved to a position of tangency to the other of said parallel lines.

35. The method as recited in claim 34 in which said fixed contact is on a bendable support, and in which said support is bent in said moving of said fixed contact to said position of tangency with said other of said parallel lines.

36. The method of adjusting the spacing of opposed pairs of contacts of a relay having a header assembly having a plurality of fixed contacts and supports therefor, and a motor assembly having a plurality of movable contacts, comprising the steps of:

positioning of said motor assembly and header assembly in a fixed spaced relationship with said contacts thereof in opposed pairs corresponding to the pairs of a completed relay but with the spacing between said pairs being greater than in a completed relay, then individually bending said supports of said fixed contacts to successively cause the spacing between each of said opposed pairs of contacts to assume a predetermined value, and then attaching said header assembly to said motor assembly in a predetermined relationship with said contacts remaining in said opposed pairs but closer together than when said motor assembly and header assembly are in said fixed spaced relationship.

37. The method as recited in claim 36 including the step of associating said header assembly and said motor assembly with an optical comparator when said assemblies are in said fixed spaced relationship so that enlarged reproductions of said contacts of said header assembly and of said motor assembly are visible on the screen of said comparator, and in which for adjusting said supports of said fixed contacts said screen is observed and said opposed pairs of contacts are adjusted to a predetermined spacing between said reproductions of said contacts on said screen.

38. The method as recited in claim 37 including the steps of inscribing parallel lines on said screen with a predetermined spacing therebetweeen, and in which for adjusting said contacts an individual pair of opposed contacts is positioned so that the image of said movable contact thereof is tangent with one of said lines, and the support of the fixed contact thereof is bent until said movable contact thereof is tangent to the other of said lines, and in which each of the remaining of said opposed pairs is so adjusted.

* * * * *